United States Patent [19]

Rolando et al.

[11] Patent Number: 4,485,503

[45] Date of Patent: Dec. 4, 1984

[54] AUTOMATIC FOOT WASHING APPARATUS

[76] Inventors: Walter Rolando, Via Marisetto 31, Vinovo (Torino); Asco Da Giau, Via Puccini 3; Mario Zogno, Via Mascagni 10, both of Pianezza (Torino), all of Italy

[21] Appl. No.: 512,197

[22] Filed: Jul. 8, 1983

[30] Foreign Application Priority Data

May 20, 1983 [IT] Italy ..... 53345/83[U]

[51] Int. Cl.[3] ..... A47K 3/022; A61H 35/00; E03C 1/00

[52] U.S. Cl. ..... 4/622; 128/25 B

[58] Field of Search ..... 4/622; 128/25 B

[56] References Cited

U.S. PATENT DOCUMENTS

| | | | |
|---|---|---|---|
| 1,025,612 | 5/1912 | Donovan | 4/622 |
| 2,312,524 | 3/1943 | Cox | 4/622 |
| 3,027,568 | 4/1962 | Blau et al. | 4/622 X |

FOREIGN PATENT DOCUMENTS

| | | | |
|---|---|---|---|
| 1429756 | 2/1969 | Fed. Rep. of Germany | 4/622 |
| 28799 | of 1903 | United Kingdom | 4/622 |
| 2033219 | 5/1980 | United Kingdom | 4/622 |

*Primary Examiner*—Henry K. Artis

*Attorney, Agent, or Firm*—McCormick, Paulding & Huber

[57] ABSTRACT

Automatic foot washing apparatus comprise a bath vessel delimiting a washing chamber and having an upper wall with two adjacent apertures provided with annular seals which, in use, sealingly surround the legs of a user. There are provided spray means associated with at least one of the side walls of the bath, washing means for supplying a washing liquid to the spray means, discharge means for discharging the washing liquid from the bath, and control means for controlling the supply means and the discharge means according to a predetermined cycle.

25 Claims, 4 Drawing Figures

AUTOMATIC FOOT WASHING APPARATUS

The subject of the present invention is washing apparatus having a simple, compact and relatively economical structure, and usable in a particularly convenient and practical manner for automatically washing the feet.

The apparatus according to the invention is characterised by the fact that it comprises a bath vessel having a bottom and four side walls delimiting a washing chamber and an upper wall having two adjacent apertures provided with annular seals which, in use, can surround the legs of the user, spray means associated with at least one of the walls of the bath, washing means for supplying a washing liquid to the said spray means, discharge means for discharging the washing liquid from the bath, and control means for controlling the supply means and the discharge means according to a predetermined automatic cycle.

Preferably, the apparatus according to the invention further comprises drying means for supplying air under pressure into the bath at the end of the washing cycle.

In a preferred embodiment of the invention, the side walls of the bath carry a plurality of washing nozzles and distinct and separate drying oulets, facing into the washing chamber and respectively connected to the said washing means and to the said drying means.

In a variant of the invention, the apparatus includes propelling means normally constituted by one or more rotating spray manifolds, for generating washing liquid movements within the said washing chamber.

The invention will now be described in detail with reference to the attached drawings, provided purely by way of non-limitative example, in which.

Figure 1:
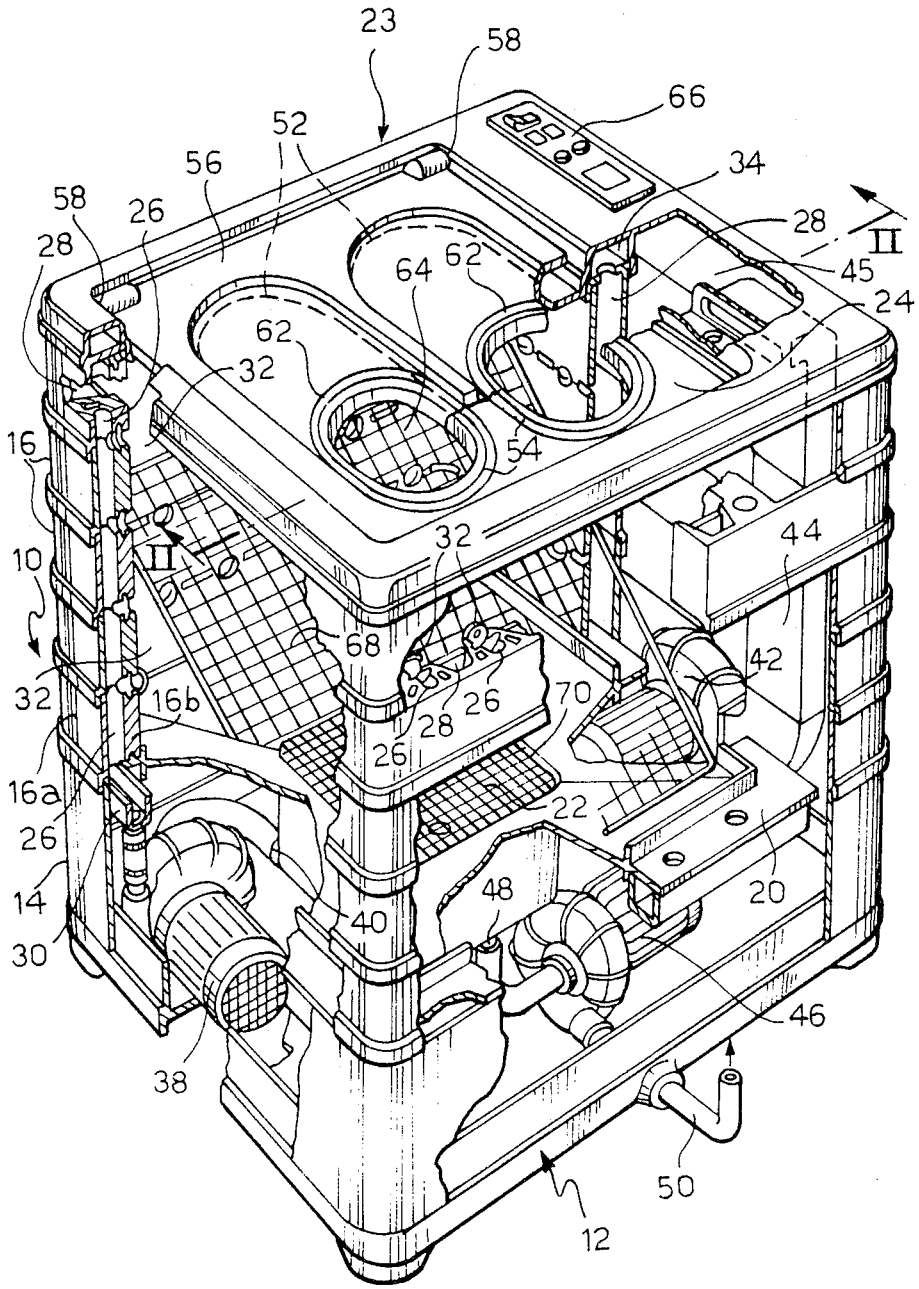
FIG. 1 is a perspective and partially sectioned view of automatic foot washing apparatus according to a first embodiment of the invention.
Figure 2:
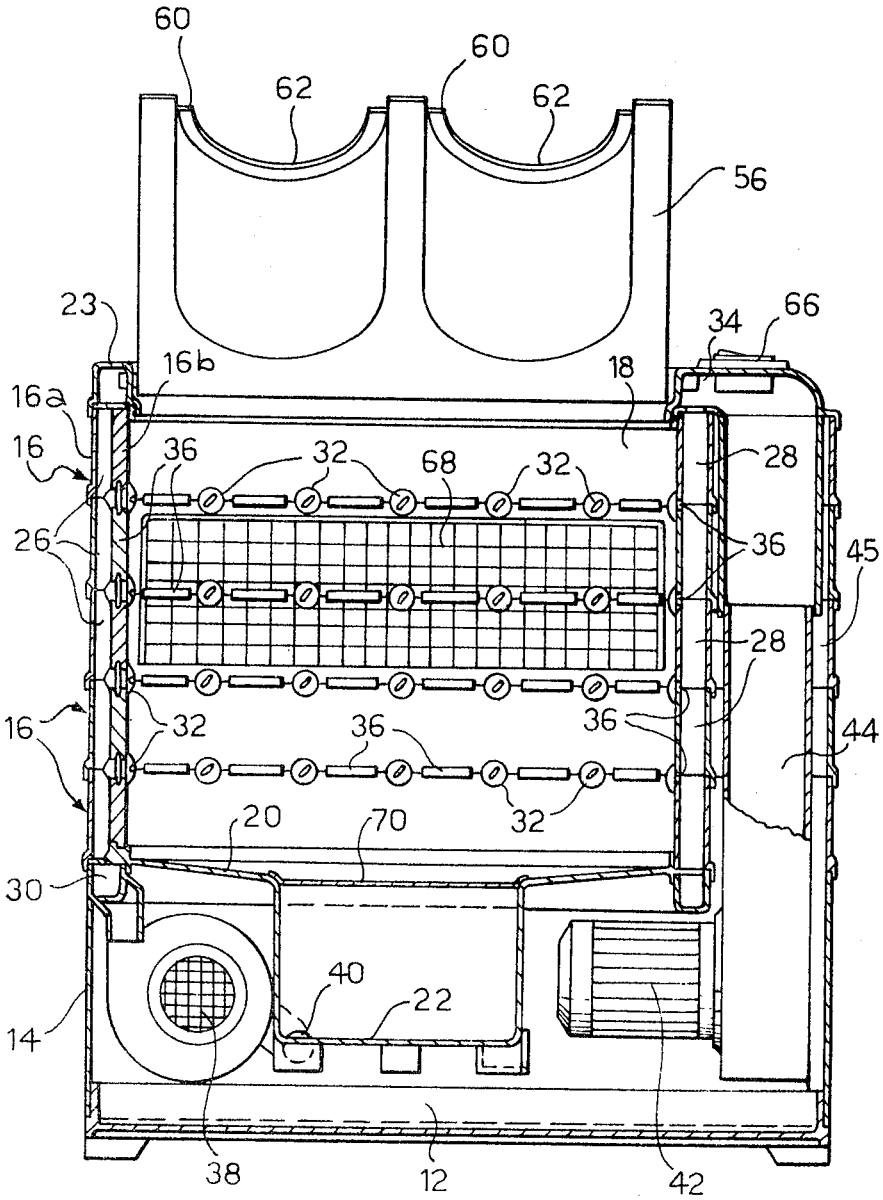
FIG. 2 is a sectional view taken on the line II—II of FIG. 1.

Referring initially to FIGS. 1 and 2, the reference numeral 10 indicates a rigid casing of parallelepiped form, the lower part 12 of which is shaped in the form of a support base provided with a lateral skirt 14 carrying a series of superimposed modular annular elements 16 which delimit an upwardly open chamber 18.

The chamber 18 is closed at the bottom by a bottom wall 20 having a central sump 22 projecting towards the base 12, and is closed at the top by means of an upper wall 23 sealingly fitted to the last annular element 16.

The annular elements 16 are preferably made of moulded plastic material, as are the base 12 and the upper part 23, and are connected together and to the base 12 by means of any conventional system, for example, by adhesive or with the aid of vertical tie bolts, not illustrated.

Each annular element 16 has a double wall 16*a*, 16*b* defining an air space divided into a plurality of first and second axial passages 26, 28 separated from one another and intercommunicating with the corresponding axial passages 26, 28 of the contiguous annular element 16.

The passages 26 communicate with an annular manifold 30 fitted below the bottom wall 20 of the lower element 16, and supply a series of washing nozzles 32 fitted to the inner walls 16*b* of the annular elements 16. The axial passages 28 communicate, on the other hand, with an annular manifold 34 formed integrally on the upper part 23, and supply a series of elongate slits 36 also formed on the inner walls 16*b* of the elements 16. The annular manifold 30 is connected to the delivery of an electrical washing pump 38 the intake of which is connected at 40 to the bottom of the sump 22, whilst the manifold 34 is connected to the delivery of an electrical drying fan 42 through a duct 44 located in a hollow lateral projection 45 integrally formed with the annular elements 16. The reference numeral 46 indicates an electrical discharge pump the intake to which is connected at 48 to the bottom of the sump 22 and the delivery of which is connected to an external discharge tube 50.

The upper wall 23 has an aperture over which is fitted a removable cover 24 having two adjacent elongate apertures 52 serving for the introduction of the user's feet into the chamber 18 and the edges at one end of which have respective substantially semi-circular seals 54 of elastomeric material fitted thereto. Following the introduction of the user's feet, the two apertures 52 are partially covered by means of a plate 56 which is pivoted at 58 to the cover 24 in such a way that it can turn between a raised position illustrated in FIG. 2 and a lowered position illustrated in FIG. 1. The edge of the plate 56 opposite the pivot 58 has two recesses 60 to the edges of which are fitted respective substantially semi-circular seals 62 of elastomeric material.

In the lowered position of the plate 56, the recesses 60 face the ends of the apertures 52 carrying the seals 54 such that these seals 54 together with the seals 62 delimit two restricted apertures 64 through which, in use, pass the legs of the user.

To the upper part 23 there is further fitted a control unit, generally indicated 66, connected to an electrical control device including, among other things, a programmable timer (not illustrated) which controls the operation of the electrical washing pump 38, the electrical drying fan 42, and the electrical discharge pump 46 according to a predetermined operating cycle, as well as possible other electrical auxiliary apparatus, such as heaters, solenoid valves, and pressure switches, not illustrated.

An inclined grille 68 is shown fitted in the chamber 18 to serve as a support for the user's feet, and the reference numeral 70 indicates a protective filtering grille the function of which is to prevent extraneous bodies from entering the sump 22.

In use, the user's feet are introduced into the washing chamber 18 through the apertures 52 of the cover 24 until they rest on the grille 68. The plate 56 is then displaced from the raised position to the lower position, thereby obtaining air tight closure of the chamber 18.

At this point the control circuit of the apparatus is activated in such a way as to provide an initial washing cycle in which water, possibly heated by means of a heater, not illustrated, and/or mixed with detergent products, is supplied to the nozzles 32 by means of the electrical pump 38 through the manifold 30 and the passages 26 of the elements 16.

At the end of this phase, the washing water is discharged from the apparatus by means of the electrical discharge pump 46, and the drying cycle follows by means of the supply of air under pressure, possibly heated, to the slits 36 through the ducts 44, the annular manifold 34 and the passages 28.

After use, the apparatus can be rinsed and washed following removal of the cover 24.

It should be noted that the pivoted plate 56 of the cover 24 could be replaced by a slidable element formed in such a way as to allow an adjustment of the size of the apertures 64 for a better adaptation to the conformation of the user's legs.

Figure 3:
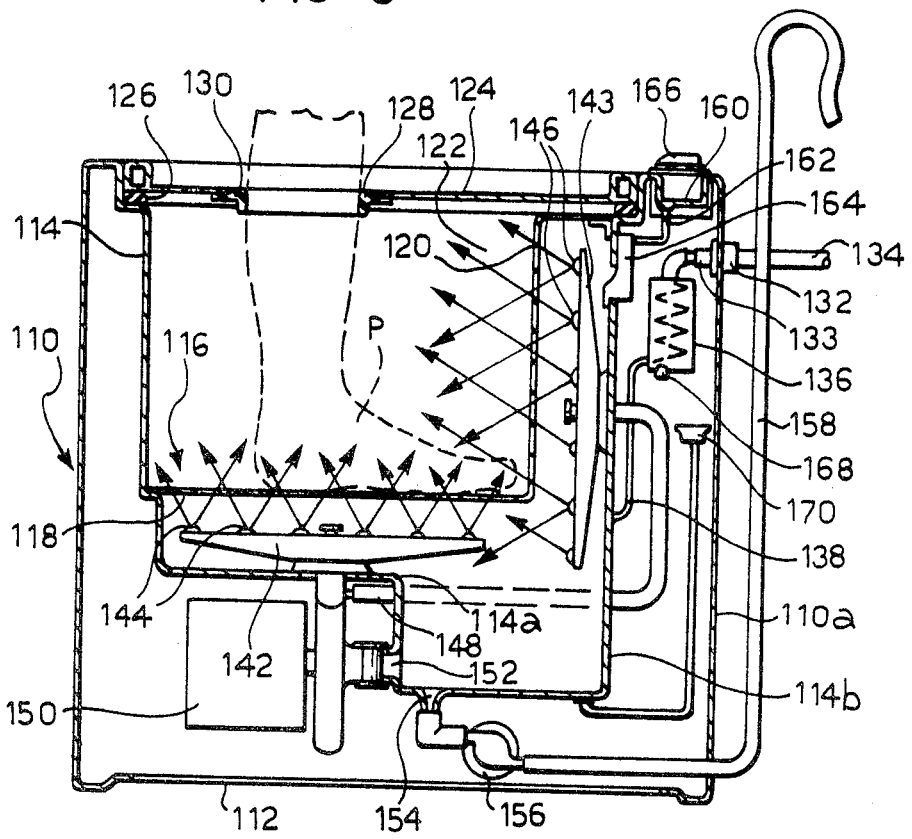
FIG. 3 is a schematic and partially sectioned view of a second embodiment of the apparatus according to the invention.
Figure 4:
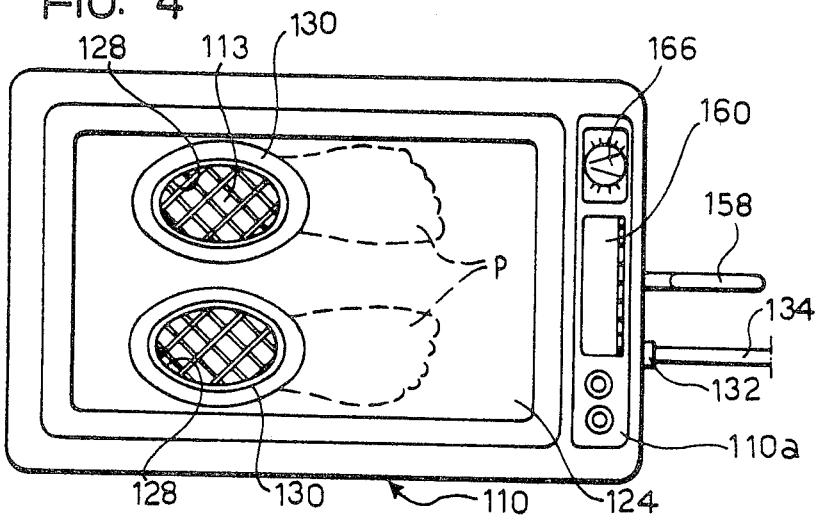
FIG. 4 is a plan view from above of FIG. 3.

In the variant illustrated in FIGS. 3 and 4, the apparatus includes a rigid casing 110 of parallelepiped form, the lower part 112 of which is shaped in the form of a support base and the upper part of which forms an upwardly open bath 114 contained in the interior of the casing 110. Within the bath 114 is disposed a grille 16 comprising a horizontal support wall 118 spaced from the bottom wall 114*a* of the bath 114, and a lateral protection wall 120 spaced from the corresponding side wall 114*b* of the bath 114.

The grille 116 defines within the bath 114 a washing chamber 122 which is closed at the top by means of a cover 124 provided with a peripheral seal 126 and having two adjacent apertures 128 on the edge of each of which is disposed an annular seal 130. The cover 124 is fitted to the edge of the bath 114 simply by forcing, and it can therefore be rapidly removed to allow the inspection and cleaning of the bath 114.

Alternatively, the cover 124 could be pivoted on one side to the edge of the bath 114 and have a configuration similar to that of the cover 24 previously described with reference to the embodiment illustrated in FIGS. 1 and 2.

A tubular input coupling 132 is shown fitted to the side wall 110*a* of the casing 110 facing the wall 114*b* of the bath 114, with which there is associated a solenoid cut-off valve 133. The tubular coupling 132 is connected on one side to an inlet tube 134 intended to be connected to a water supply, and on the opposite side to a high speed electrical resistance heater 136 of type known per se. The heater 136 is in turn connected to the interior of the bath 114 through a supply duct 138.

The reference numerals 142 and 143 indicate two rotating manifolds, one of which turns about a vertical axis and the other about a horizontal axis, which are fitted within the bath 114 respectively adjacent the bottom wall 114*a* and the side wall 114*b*, and are provided with respective spray nozzles 144, 146 directed towards the bottom wall 118 and towards the side wall 120 of the grille 16 respectively. The two rotating manifolds 142 and 143, which are interconnected by a tube 148, are supplied by means of an electrical pump 150 located externally of the bath 114 and the input of which is connected to the bottom thereof through an aperture 152. The bottom wall 114*a* of the bath 114 has a second aperture 154 connected, by an electrical discharge pump 156, to a flexible discharge tube 158. In the upper part of the casing 110 there is located a receptacle 160 intended to contain a liquid detergent product, and which is connected, by a duct 162 and an electrically-controlled valve 164, to the interior of the bath 114. The apparatus is provided with an electrical control device including, among other things, a programmable timer 166 which controls the solenoid valve 133, the heater 136, the electrical pumps 150, 156 and the electrically-controlled valve 164. The control circuit further includes a thermostat 168 associated with the heater 136, and a pressure switch 170 connected to the bottom of the bath 114 and arranged to control the opening and closing of the solenoid valve 133.

In use, the user's feet P are introduced into the washing chamber 122 through the apertures 128 in the cover 124, until they rest on the bottom wall 118 of the grille 116. In this position, the annular seals 130 of the apertures 128 surround the lower portions of the user's legs, providing an effective air-tight closure of the washing chamber 122. At this point, the control circuit of the apparatus is activated by the programmable timer 166 in such a way as to obtain a predetermined washing cycle which initially comprises the introduction into the lower part of the bath 114, through tube 134, the solenoid valve 133 and the inlet duct 138, of water heated to the desired temperature by means of the heater 136, and the simultaneous ingress of a predetermined quantity of the liquid detergent contained in the receptacle 160, through the electrically controlled valve 164. As soon as the desired level within the bath 114 has been reached, the supply of water is interrupted by the pressure switch 170 and the electrical pump 150 which supplies water mixed with detergent to the two rotating manifolds 142 and 143 is activated. These latter are rotatable by reaction and provide an effective washing of the feet P due to the jets issuing from the respective spray nozzles 144 and 146.

At the end of this phase, the electrical pump 150 is de-activated and the washing water is discharged from the apparatus by means of the electrical discharge pump 156.

The control circuit is also arranged to effect a subsequent rinsing cycle in which clean water is supplied to the bath 114 and subsequently sent to the rotating manifolds 142 and 143 without the introduction of detergent.

The apparatus can further be arranged to effect a final drying cycle by directing heated air into the chamber 122 through the rotating manifolds 142 and 143 or other suitable ducts connected to an electrical fan, not illustrated.

It should be noted that the two rotating manifolds 142 and 143 could be replaced by a simple lateral impeller immersed in the washing liquid supplied to the bath 114 and serving to agitate this washing liquid in the chamber 122.

Finally, it should be observed that the use of the heater 136, the receptacle 160, and the electrically controlled valve 164, as well as the solenoid valve 133 and the pressure switch 170, can be extended normally to the apparatus of the embodiment illustrated in FIGS. 1 and 2.

What is claimed is:

1. Automatic foot washing apparatus comprising a bath vessel having a bottom and four side walls delimiting a washing chamber and an upper wall defining two adjacent apertures; respective annular seals fitted to said apertures for sealingly surrounding a user's legs in use; a removable cover with two elongate holes; a respective substantially semi-circular seal fitted to the edge of each hole at one end thereof; a plate pivoted to the cover and defining two recesses at one end, and respective substantially semi-circular seals which are fitted to the edges of the recesses, said plate being displaceable between a raised position in which it allows the introduction of the user's feet through the elongate holes, and a lowered position in which it partially covers the elongate holes and the semi-circular seals fitted to the edges of the recesses face the semi-circular seals at the ends of the elongate holes; spray means associated with at least one of the walls of the bath; washing means for supplying a washing liquid to the spray means; discharge means for discharging the washing liquid from the bath, and control means for controlling the supply means and the discharge means according to a predetermined automatic cycle.

2. Apparatus as defined in claim 1, wherein it further includes drying means for supplying air under pressure into the bath at the end of the washing cycle.

3. Apparatus as defined in claim 1, wherein it further includes heater means for heating the washing liquid supplied to the bath.

4. Apparatus as defined in claim 1, wherein a plurality of washing nozzles and a plurality of separate drying outlets are carried by the side walls of the bath, which face into the washing chamber and are connected respectively to said washing means and said drying means.

5. Apparatus as defined in claim 1, wherein an inclined foot-rest grille is located within the bath.

6. Apparatus as defined by claim 4, wherein the side walls of the bath are formed by a series of superimposed modular annular elements, and each modular element has a double wall defining an air space sub-divided into a plurality of distinct first and second axial passages whereby the corresponding axial passages of contiguous annular elements intercommunicate, said first and second passages being connected respectively to said washing means and said drying means and communicating respectively with the washing nozzles and the drying outlets.

7. Apparatus as defined in claim 1, wherein it further includes propelling means controlled by said control means to generate movements within the washing liquid in said washing chamber.

8. Apparatus as defined in claim 1, wherein the bath further includes an inner protective and support grille, said grille comprising a bottom wall and a side wall spaced from the bottom wall and the corresponding side wall of the bath, and wherein the propelling means include at least one rotating manifold provided with spray nozzles facing said grille and an electrical pump for directing the washing liquid supplied to the bath under pressure to said at least one rotating manifold.

9. Apparatus as defined in claim 7, wherein the supply means and the heater means include a supply tube connected at one end to the bath; an inlet coupling provided at the other end of said supply tube and connectible to a water supply; a solenoid cut-off valve associated with said inlet coupling; a receptacle for containing a detergent product; a duct for connecting said receptable to the bath; an electrically-controlled valve in said duct, and a high speed electrical resistance heater located in the supply tube, the solenoid valve, the electrically-controlled valve and the heater being connected to said control means.

10. Apparatus as defined in claim 1, wherein said discharge means include an electrical discharge pump connected to said control means.

11. Apparatus as defined in claim 1, wherein the control means further include a thermostat sensitive to the temperature of the water at the output from the heater means, and a pressure switch connected to the bottom of the bath.

12. Automatic foot washing apparatus, wherein it comprises a bath vessel having a bottom and four side walls delimiting a washing chamber and an upper wall defining two adjacent apertures; respective annular seals fitted to said apertures for sealingly surrounding a user's legs in use; a plurality of washing nozzles associated with the side walls of the bath; washing means for supplying a washing liquid to the nozzles, discharge means for discharging the washing liquid from the bath, drying means for supplying air under pressure into the bath at the end of a washing cycle, a plurality of separate drying outlets carried by the side walls of the bath, which face into the washing chamber and are connected to said drying means, the side walls of the bath being formed by a series of superimposed modular annular elements, and each modular element having a double wall defining an air space sub-divided into a plurality of distinct first and second axial passages whereby the corresponding axial passages of contiguous annular elements intercommunicate, said first and second passages being connected respectively to said washing means and said drying means and communicating respectively with the washing nozzles and the drying outlets, and control means for controlling the supply means and the discharge means according to a predetermined automatic cycle.

13. Apparatus as defined in claim 12 wherein it further includes heater means for heating the washing liquid supplied to the bath.

14. Apparatus as defined in claim 12, wherein an inclined foot-rest grille is located within the bath.

15. Apparatus as defined in claim 12, wherein it further includes propelling means controlled by said control means to generate movements within the washing liquid in said washing chamber.

16. Apparatus as defined in claim 15, wherein the bath further includes an inner protective and support grille, said grille comprising a bottom wall and a side wall spaced from the bottom wall and the corresponding side wall of the bath, and wherein the propelling means include at least one rotating manifold provided with spray nozzles facing said grille and an electrical pump for directing the washing liquid supplied to the bath under pressure to said at least one rotating manifold.

17. Apparatus as defined in claim 15, wherein the supply means and the heater means include a supply tube connected at one end to the bath; an inlet coupling provided at the other end of said supply tube and connectible to a water supply; a solenoid cut-off valve associated with said inlet coupling; a receptacle for containing a detergent product; a duct for connecting said receptacle to the bath; an electrically-controlled valve in said duct, and a high speed electrical resistance heater located in the supply tube, the solenoid valve, the electrically-controlled valve and the heater being connected to said control means.

18. Apparatus as defined in claim 12, wherein said discharge means include an electrical discharge pump connected to said control means.

19. Apparatus as defined in claim 12, wherein the control means further include a thermostat sensitive to the temperature of the water at the output from the heater means, and a pressure switch connected to the bottom of the bath.

20. Automatic foot washing apparatus, wherein it comprises a bath vessel having a bottom and four side walls delimiting a washing chamber and an upper wall defining two adjacent apertures; respective annular seals fitted to said apertures for sealingly surrounding a user's legs in use; spray means associated with at least one of the walls of the bath; washing means for supplying a washing liquid to the spray means; discharge means for discharging the washing liquid from the bath, propelling means to generate movements within the washing liquid in said washing chamber, heater means for heating the washing liquid supplied to the bath, and control means for controlling the supply means, the discharge means and propelling means according to the predetermined automatic cycle, said supply means and the heater means including a supply tube connected at one end to the bath; an inlet coupling provided at the other end of said supply tube and connectible to a water supply; a solenoid cut-off valve associated with said inlet coupling; a receptacle for containing a detergent product; a duct for connecting said receptacle to the bath; an electrically-controlled valve in said duct, and a high speed electrical resistance heater located in the supply tube, the solenoid valve, the electrically-controlled valve and the heater being connected to said controls means.

21. Apparatus as defined in claim 20, wherein it further includes drying means for supplying air under pressure into the bath at the end of the washing cycle.

22. Apparatus as defined in claim 20, wherein an inclined foot-rest grille is located within the bath.

23. Apparatus as defined in claim 7, wherein the bath further includes an inner protective and support grille, said grille comprising a bottom wall and a side wall spaced from the bottom wall and the corresponding side wall of the bath, and wherein the propelling means include at least one rotating manifold provided with spray nozzles facing said grille and an electrical pump for directing the washing liquid supplied to the bath under pressure to said at least one rotating manifold.

24. Apparatus as defined in claim 20, wherein said discharge means include an electrical discharge pump connected to said control means.

25. Apparatus as defined in claim 20, wherein the control means further include a thermostat sensitive to the temperature of the water at the output from the heater means, and a pressure switch connected to the bottom of the bath.

* * * * *